United States Patent [19]

Millar et al.

[11] Patent Number: 4,773,130

[45] Date of Patent: Sep. 27, 1988

[54] LOCKABLE SAFETY-PINS

[75] Inventors: Robert G. Millar, Wootton Wawen; Martin J. Horne, Kinver, both of England

[73] Assignee: Newey Goodman Limited, Tipton, England

[21] Appl. No.: 19,290

[22] Filed: Feb. 26, 1987

[30] Foreign Application Priority Data

Mar. 1, 1986 [GB] United Kingdom ..... 8605133

[51] Int. Cl.[4] ..... A44B 9/14

[52] U.S. Cl. ..... 24/155 R; 24/155 SD; 24/161

[58] Field of Search ..... 24/155 R, 151, 156, 24/150 R, 150 B, 157 R, 158 R, 161

[56] References Cited

U.S. PATENT DOCUMENTS

| | | | |
|---|---|---|---|
| 737,068 | 8/1903 | Briel et al. | 24/155 R |
| 2,296,449 | 9/1942 | Meisenheimer | 24/156 R |
| 2,668,996 | 2/1954 | Kummli | 24/158 R |
| 2,772,462 | 12/1956 | Trachsler | 24/158 R |
| 2,893,091 | 7/1959 | Mitchell | 24/158 R |
| 3,002,243 | 10/1961 | Turner et al. | 24/156 R |
| 3,135,035 | 6/1964 | Jenison | 24/161 R |
| 3,267,541 | 8/1966 | Chrones . | |
| 4,404,713 | 9/1983 | Dorsey | 24/155 SD |
| 4,412,368 | 11/1983 | Springer | 24/161 |

FOREIGN PATENT DOCUMENTS 793060 4/1958 United Kingdom .

*Primary Examiner*—Victor N. Sakran

*Attorney, Agent, or Firm*—Scrivener and Clarke

[57] ABSTRACT

A safety-pin (1,22,38) of a conventional kind is provided with a sheath (2,23,39) made as a unitary moulding of plastics or like material. The sheath is slidable between a release state, in which it does not prevent the pin being opened and closed at will, and a locking state in which it does prevent the pin being opened from a closed state. To this end the sheath has barring means, comprising one or more abutments (15,30,41), which obstruct a movable limb (4) of the pin. Each abutment has an inclined face (16,31,42) which engages the end (21) of the cap (6) of the pin, while the sheath is being pushed onto the cap during a first stage of assembly, and causes the barring means to move resiliently aside from its normal position. During a later stage of assembly the barring means returns resiliently to substantially its normal position. Any attempt to pull the sheath off the cap is positively resisted by engagement between the abutment or abutments and the cap.

12 Claims, 6 Drawing Sheets

LOCKABLE SAFETY-PINS

Figure 1:
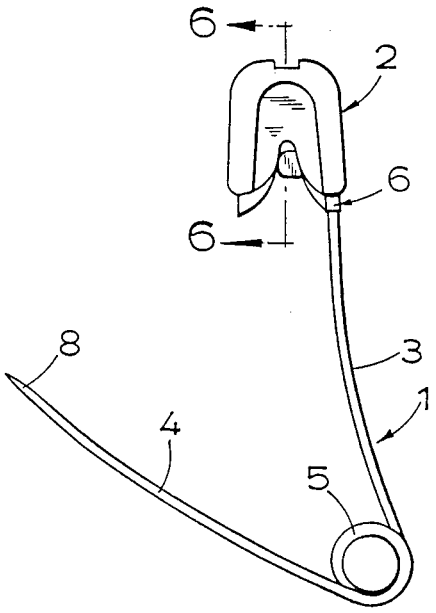

This invention relates to lockable safety-pins, and in particular to lockable safety-pins of the kind incorporating a safety-pin of the well-known kind (hereinafter referred to as a safety-pin of the kind specified) capable of being moved between open and closed states, the safety-pin comprising first and second wire limbs, the first wire limb having a cap at one end and being connected at the other end to the second wire limb, an end portion of the second limb remote from the connection with the first limb being releasably engaged with the cap when the pin is in its closed state and being free from the cap when the pin is in its open state, said end portion, when engaged with the cap, being disposed in a recess in the cap opening towards said first wire limb and being resiliently retained there.

It is normal for said end portion of the second limb to be shaped so as to present a sharp point.

When safety-pins are to be used for certain purposes, such as for securing diapers on infant children, it is desirable to provide locking means enabling the pins to be releasably locked in their closed states so as to prevent the pins being unintentionally or inadvertently opened and possibly causing injury or damage.

A known kind of locking means comprises a sheath (hereinafter referred to as a sheath of the kind specified) fitted over the cap of a safety-pin and slidable between locking and release states, the sheath including barring means, the arrangement being such that when the pin is in its closed state and the sheath is in its locking state the barring means prevents the pin being moved to its open state, but when the sheath is in its release state the barring means no longer prevents the pin being moved to its open state.

Safety-pins of the kind specified, having sheaths of the kind specified, are described and illustrated in the complete specification of British Patent No. 793 060 granted to George Goodman Limited.

The manufacture of a lockable safety-pin, comprising a safety-pin assembled with a sheath, is relatively expensive in that the sheath is made from a corrosion-resistant metal such as stainless steel or made from metal with a corrosion-resistant coating and in that is requires a plurality of steps in its manufacture and assembly with the safety-pin.

An aim of the present invention is to provide a lockable safety-pin that can be made and assembled relatively simply.

From a first aspect the present invention consists in a lockable safety-pin comprising a safety-pin of the kind specified provided with a sheath of the kind specified, characterised in that the barring means is resiliently mounted and is so shaped that the sheath can be assembled with the safety-pin by the sheath and cap being forced together so that there is relative endwise movement between them, the barring means so engaging an upstanding portion of the cap during an initial stage of that relative endwise movement that the barring means is moved aside from a normal position, and the barring means resiliently returning at least substantially to its normal position during a subsequent stage of that relative endwise movement, any attempt to remove the sheath from the cap, after assembly, by relative movement between the sheath and the cap in a reverse direction being positively resisted by engagement between the barring means and the cap.

From a second aspect the present invention consists in a safety-pin of the kind specified and a sheath of the kind specified, which can be assembled to form a lockable safety-pin in accordance with the first aspect of the present invention.

From a third aspect the present invention consists in a sheath of the kind specified for use as part of a lockable safety-pin in accordance with the first aspect of the present invention.

From a fourth aspect the present invention consists in a method of making a lockable safety-pin comprising a sheath of the kind specified assembled with a safety-pin of the kind specified, in which method said sheath and said cap are preformed and are forced together so that there is relative endwise movement between them, the barring means so engaging an upstanding portion of the cap during an initial stage of that relative endwise movement that the barring means is moved aside from a normal position, the barring means resiliently returning, at least substantially, to its normal position during a subsequent stage of that relative endwise movement and after said abutment means has passed the upstanding portion. Any, attempt to remove the sheath from the cap, after assembly and during normal use, by relative movement between the sheath and cap in a reverse direction being positively prevented by engagement between the barring means and the cap.

The sheath is preferably made as a unitary moulding from a flexible and resilient material such as a plastics material or a material incorporating or comprising natural or synthetic rubber.

The barring means preferably has at least one inclined face for engagement with upstanding portion of the cap, to assist in moving the barring means aside from its normal position. The barring means preferably comprises a pair of mutually opposed, inwardly directed abutments. Moreover, the barring means preferably comprises at least one abutment of hook-like shape such that when there is any such attempt to remove the sheath from the cap by relative movement between the sheath and the cap in said reverse direction, the abutment hooks onto the cap and thereby affords positive resistance to removal of the sheath from the cap.

Inside the sheath there is preferably at least one friction pad, adjacent to the abutment or to an associated one of the abutments, which frictionally engages the cap to prevent free movement of the sheath, at least when the sheath is in its release state. In a preferred arrangement, when the sheath is in its locking state the friction pad or each friction pad does not frictionally engage the cap, but an end portion of the friction pad lies adjacent to part of the cap and prevent free movement of the sheath from its locking state.

The outside of the sheath is preferably formed with recessed areas which can receive the tips of a user's finger and thumb and enhance the user's grip on the sheath when the sheath is being moved from its locking state to its release state.

If desired, the barring means comprises an abutment provided on at least one flexible and resilient arm cantilevered from the remainder of the sheath, the arrangement being such that during assembly of the sheath with the safety-pin the arm or each arm flexes resiliently.

The arrangement may be such that when the sheath is in its release state said end portion of the second limb of the pin can be moved between open and closed states by displacement through either face of the cap at will.

Alternatively the arrangement may be such that when the sheath is in its release state said end portion of the second limb of the pin can be moved between the open and closed state by displacement through one face only of the cap. In this case the sheath may be closed on one face, so preventing movement of said end portion into or from the recess in the cap by way of that face. The closed face of the sheath may carry a decorative design.

Figure 2:
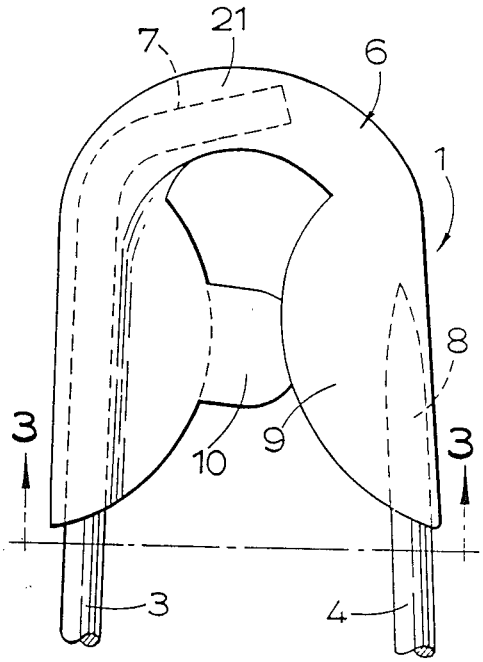
Figure 4:
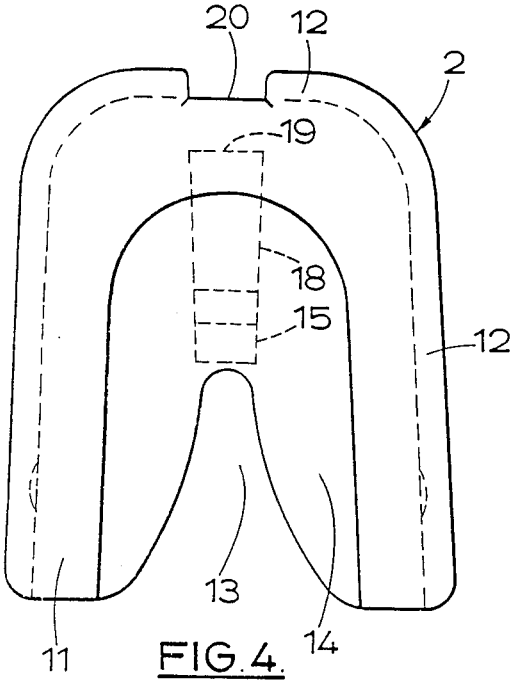
Figure 3:
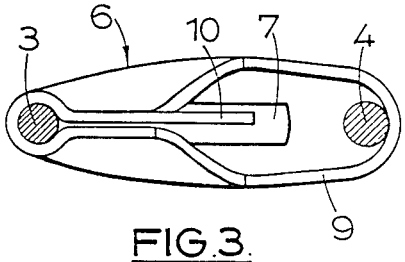
Figure 5:
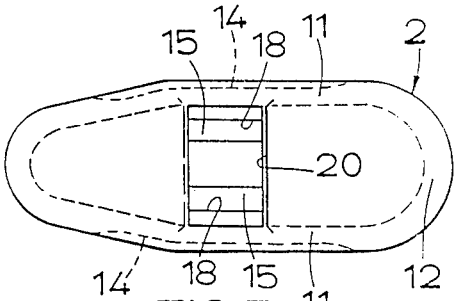
Figure 6:
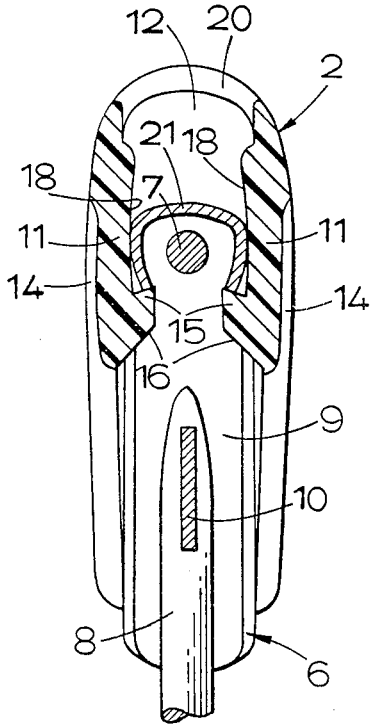
Figure 7:
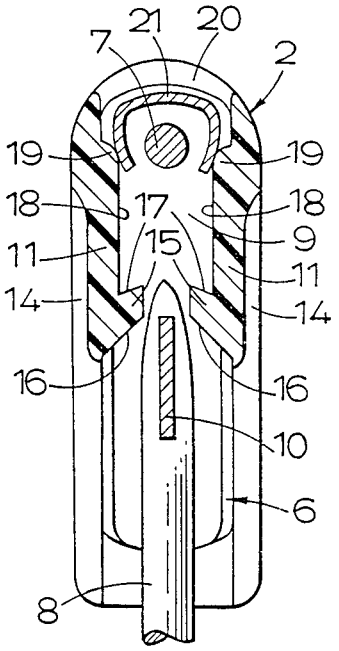
Figure 8:
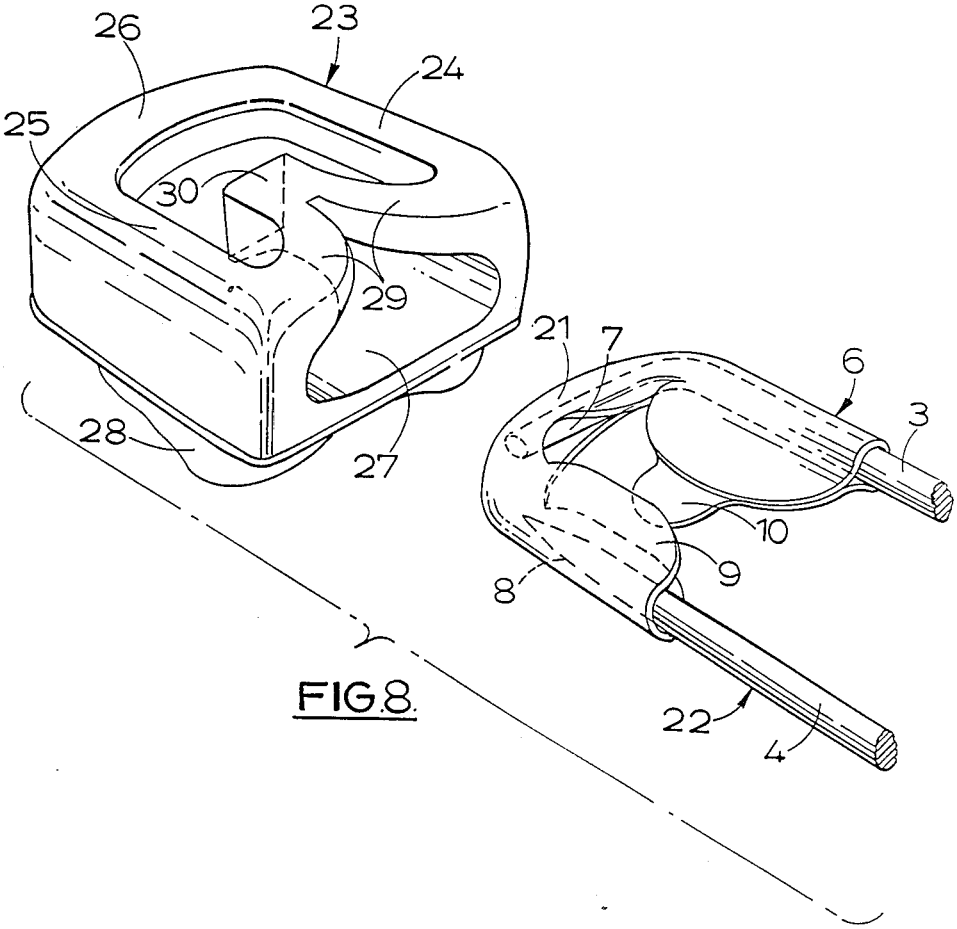
Figure 9:
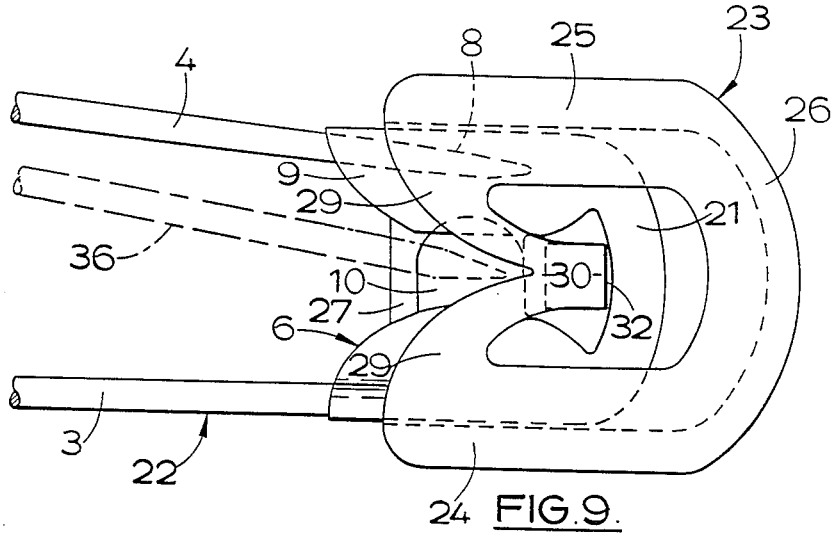
Figure 10:
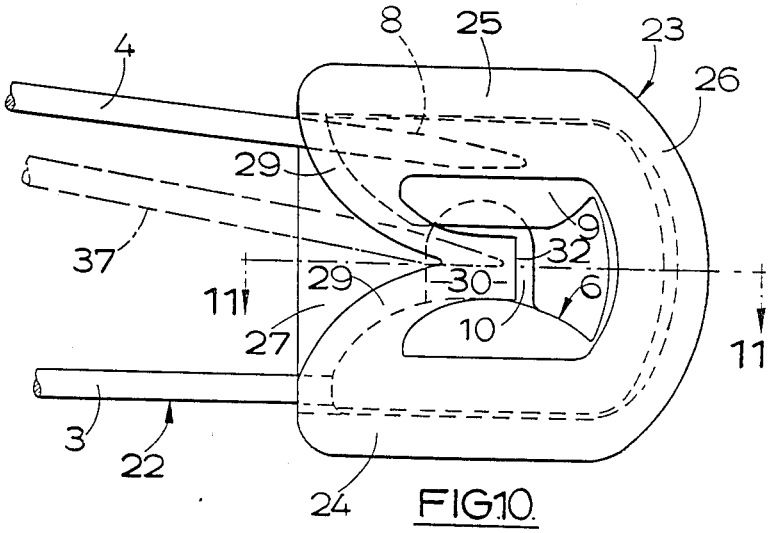
Figure 11:
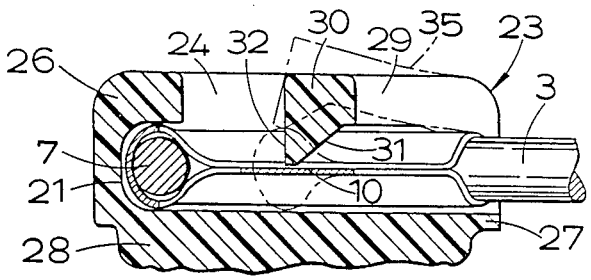
Figure 12:
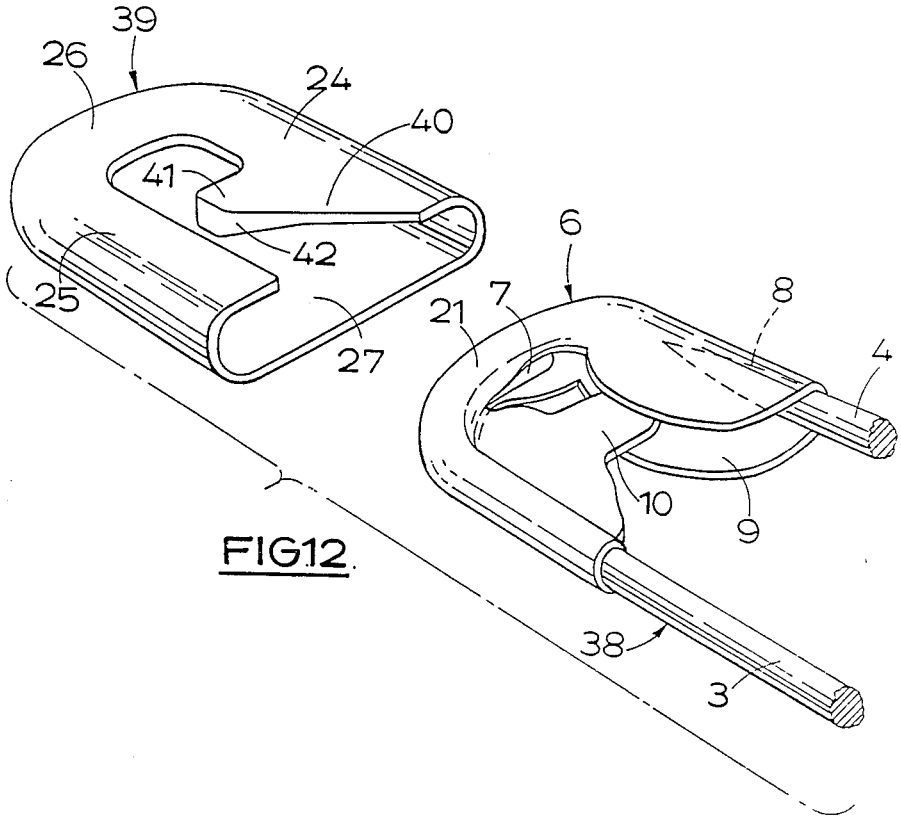
Figure 13:
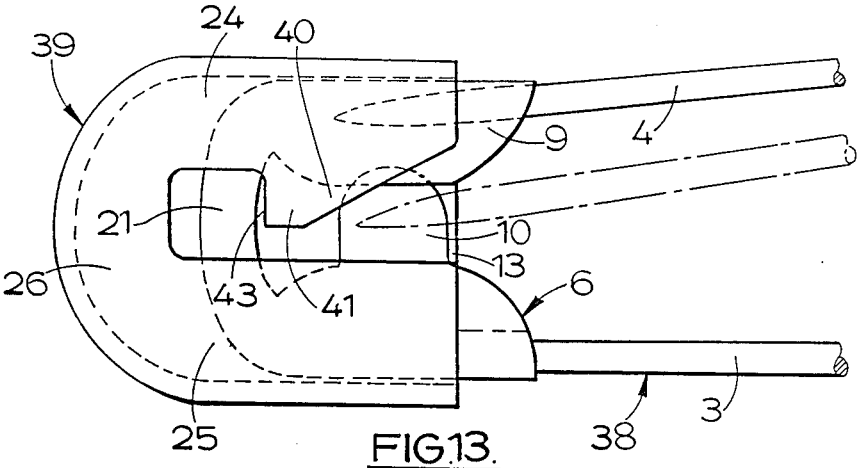
Figure 14:
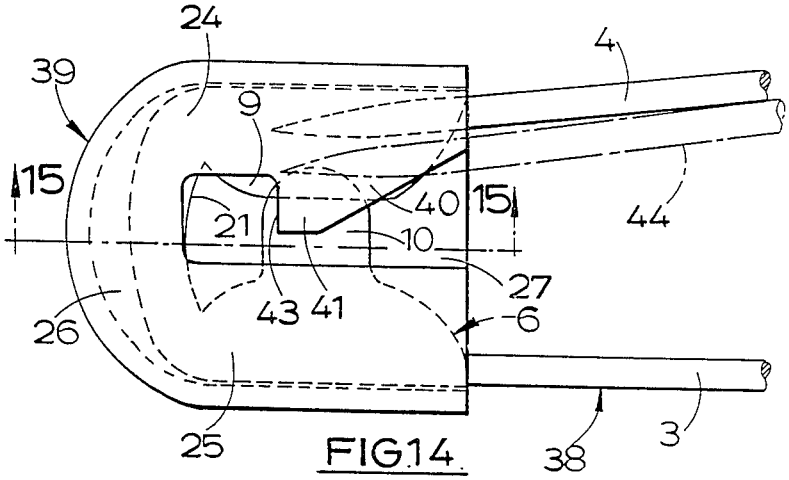
Figure 15:
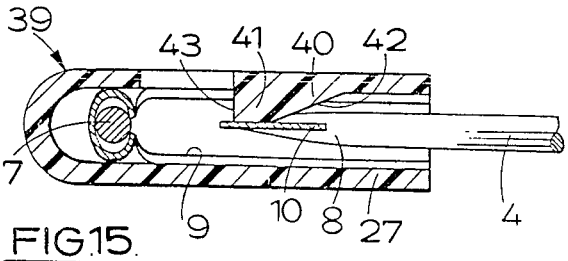

Embodiments of the present invention will now be described in more detail, by way of example, with reference to the accompanying drawings, in which:

FIG. 1 is a side view of a lockable safety-pin embodying the present invention,

FIG. 2 is a side view from the other side and to a larger scale, of the cap-end of a safety-pin forming part of the assembly shown in FIG. 1, FIG. 3 is a section on the line 3—3 of FIG. 2, FIG. 4 is a side view, to the same scale as FIGS. 2 and 3, of a sheath forming part of the assembly shown in FIG. 1, FIG. 5 is a plan view of the sheath shown in FIG. 4, FIG. 6 is a section, to a larger scale, along the line 6—6 of FIG. 1, but with the pin in its closed state, FIG. 7 is a section similar to FIG. 6 but showing the cap and sheath in different relative positions, FIG. 8 is a perspective view of part of a safety-pin and of a second form of sheath about to be assembled with it, FIG. 9 is an elevation of the pin and sheath of FIG. 8 after assembly, with the sheath in its release position, FIG. 10 is similar to FIG. 9 but shows the sheath in a locking state, FIG. 11 is a section along the line 11—11 of FIG. 10, FIG. 12 is a perspective view of a part of a safety-pin and of a third design of sheath about to be assembled with it, FIG. 13 is an elevation of the pin and sheath of FIG. 12 after assembly, with the sheath in its release state, FIG. 14 is similar to FIG. 13 but shows the sheath in its locking state, and FIG. 15 is a section substantially along the line 15—15 of FIG. 14.

Referring first to the embodiment of the invention illustrated in FIGS. 1 to 7, the reference numeral 1 indicates a safety-pin of the kind specified and reference numeral 2 indicates a sheath of the kind specified.

The pin 1 is of a well-known kind and comprises a first wire limb 3 and a second wire limb 4. The limbs 3 and 4 are integrally connected at one end by a circular loop of wire 5 which constitutes a spring, the wire from which the limbs and loop are made being resilient. At its other end the first limb 3 carries a sheet-metal cap 6, an end portion 7 of the limb being bent relatively to the remainder of the limb and serving as an anchorage for an end portion of the cap. An end portion 8 of the second limb 4 is formed with a point. The cap 6 is formed with a channel-shaped portion 9 which defines a recess which opens towards the first limb 3. When the pin is in its closed state, as illustrated in FIG. 2, the end portion 8 of the second limb 3 is disposed in the recess in the portion 9 of the cap and is retained there owing to the resilience of the wire from which the limbs 3 and 4 and loop 5 are formed. A tongue 10, constituting another part of the cap, projects into the mouth of the recess and assists in guiding the end portion 8 into the recess, when the pin is being moved from its open state (FIG. 1) to its closed state (FIG. 2).

The sheath 2 is of the kind specified and is made as a unitary moulding of a plastics material such as nylon, an acetal resin or an ABS resin. The sheath has a hollow interior and an open mouth at one end and is so shaped that is can fit over the cap 6 of the safety-pin. The sheath 2 has spaced side walls 11 connected at their top and lateral edges by a portion 12 of channel-shaped cross-section. Each of the side walls 11 is cut away from its lower edge to form a through opening 13 of tapered shape. The outer surface of that part of each side wall adjacent to the opening 13 is formed with a recessed area 14, which is bounded at its top and lateral edges by outwardly projecting portions of the sheath. Immediately above the openings 13 there is formed a pair of mutually opposed, inwardly directed abutments 15. As can best be seen in FIGS. 6 and 7 each of the abutments 15 has a lower face 16 which is inclined upwards and inwards of the sheath. In addition, each abutment has a similarly inclined upper face 17, so that the abutment has a hook-like shape. A friction pad 18, constituting an integral part of the sheath, extends upwards from each of the abutments 15 and terminates at its upper end with end portions 19 of convex, rounded shape. A hole 20 is provided in the top of the sheath and is formed by a portion of a moulding tool which defines the upper faces 17 of the abutments and the rounded upper end faces of the friction pads. If the hole 20 were omitted, a more complex technique would have to be used for moulding the sheath.

In the manufacture of the lockable safety-pin, the safety-pin 1 and the sheath 2 are individually made and are then assembled together. During assembly, the sheath is pushed endwise onto the pin so that the cap 6 enters the open mouth of the sheath. During an initial stage of this movement, the inclined lower faces 16 of the abutments 15 engage the uppermost part 21 of the cap 6 which, as can be seen in FIGS. 6 and 7, is of inverted channel-shape. Continuation of that movement causes the abutments 15 to be bodily moved aside from their initial, normal portion. As this occurs, the side walls 11 of the sheath are caused to swell outwards resiliently. On further movement the abutments 15 snap towards each other beneath the uppermost part 21 of the cap, as shown in FIG. 6. The abutments have thus returned substantially to their normal position. Any attempt to remove the sheath from the cap after assembly, by reverse movement of the sheath, is positively and strongly resisted by the engagement between the upper faces 17 of the abutments and the adjacent edges of the part 21 of the cap. As can be seen in FIG. 6, in fact, the abutments hook onto that part of the cap.

Although the sheath cannot be removed from the cap (at least in normal use), it is capable of limited endwise sliding movement relative, to the cap between a release state (as shown in FIGS. 1 and 6) and a locking state (as shown in FIG. 7). When the sheath is in its release state, the pin can be moved between open and closed states, with the pointed end portion 8 of the limb 3 of the pin passing through either one of the openings 13 in the sheath 2 at will. When the sheath is in its release state, the friction pads 18 frictionally grip the uppermost part 21 of the cap; this prevents the free movement of the sheath relatively to the cap. The grip results from the fact that the width of the part 21 of the cap is slightly greater than the distance between the pads 18 (when the sheath is in its normal unstressed state), so that the side walls 11 of the sheath are bowed outwards to a slight extent, as can be seen in FIG. 6, when the sheath is in its release state.

The user can quite readily push the sheath further onto the cap 6, although the friction pads 18 do afford some resistance to movement. Eventually the sheath snaps into its final locking state shown in FIG. 7. When the sheath is in its locking state the pin cannot be moved from its closed state to its open state as the pointed end portion 8 of the wire limb 4 cannot be moved outside the sheath owing to the presence of the abutments 15 and adjacent parts of the sheath. The abutments 15 together with the adjacent parts of the sheath therefore constitute barring means. Further, although the friction pads 18 no longer frictionally engage the part 21 of the cap, the upper end portions 19 of the pads lie adjacent to the part 21 of the cap and prevent free movement of the sheath from its locking state.

Finally, when the user wishes to return the sheath 2 from its locked state to its release state, he or she can grip the sheath between his or her finger and thumb and pull the sheath to the position shown in FIG. 6. The finger and thumb enter the recessed areas 14, and the presence of the surrounding, unrecessed parts of the sheath reduce the likelihood of the user's finger and thumb inadvertently sliding from the sheath. During the initial stages of that movement, the end portions 19 of the friction pads ride onto the part 21 of the cap, and the sheath swells or bows outwards resiliently, as described above.

Turning now to the locking safety-pin illustrated in FIGS. 8 to 11, this includes a pin 22 similar to the pin 1. For convenience, like parts of the pins are given the same reference numerals. The assembly also includes a sheath 23 which is made as a unitary moulding of a material which may be similar to that from which the sheath 2 is moulded. The sheath has a hollow interior and an open mouth at one end and is so shaped that it can fit over the cap 6 of the safety-pin 22. To this end it has parallel edge portions 24 and 25 of channel-shaped cross-section and with the mouths of the channels opening towards each other, ends of the edge portions being interconnected by an arcuate end portion 26 which is also of channel-shaped cross-section. A rear face of the sheath is closed by a plate 27 which is formed on its outer surface with a decorative design 28 in relief. The design may, for example, represent a flower or a face such as the face of a teddy-bear. A front face of the sheath is largely open, but a pair of curved arms 29 project into it from ends of the edge portions 10 and 11. The arms are integrally connected to an abutment 30, a portion of which projects into the hollow interior of the sheath and is formed with an inclined face 31, which faces the open mouth of the sheath, and a transverse abutment face 32, which faces the end portion 11 of the sheath.

During assembly of the pin 22 with the sheath 23, the sheath is pushed endwise onto the pin so that the cap enters the open mouth of the sheath. During an initial stage of this movement the inclined face 31 of the abutment 30 engages an upstanding end portion 21 of the cap, around the end portion 7 of the first limb 3 of the pin, so that continuation of this movement causes the abutment 30 to be moved aside from its normal position, as indicated by the broken lines 35 in FIG. 11. As this occurs the curved arms 29 bend resiliently. During a subsequent stage of movement the abutment is returned to or close to its normal position by the arm 29. Any attempt to remove the sheath from the cap after assembly, by reverse movement of the sheath, is positively and strongly resisted by engagement between the abutment face 32 of the abutment and the end portion 21 of the cap.

Although the sheath 23 cannot be removed from the cap (at least in normal use), it is capable of limited endwise sliding movement relative to the cap between a release state (as shown in FIG. 9) and a locking state (as shown in FIG. 10). When the sheath is in its release state, with the abutment face 32 engaging the end portion 21 of the cap, it is possible to open and close the pin in the usual way as the end portion 8 of the second wire limb 4 can pass between the curved arms 29 that support the barring means. This is indicated by the broken lines 36 in FIG. 9. The presence of the plate 27, of course, prevents the end portion 8 being moved to its open state through the rear face of the sheath. When the sheath is in its locking state (FIG. 10), the abutment 30 obstructs movement of the end portion 8 from its closed state to its open state. In the arrangement illustrated by the broken lines 37 in FIG. 10, the end portion 8 is able to pass between the abutment 30 and the tongue 10. In modified construction, however, that is not illustrated, the end portion 8 cannot be moved from its fully closed state in the recess in the channel-shaped portion 9 to the position indicated by the broken lines 37 as it abuts a side face of the abutment 30 and is thus prevented from occupying a position between the abutment and the tongue 10. In the arrangement illustrated, the barring means comprises the abutment 30, together with part of the arms 29, while in the modified construction, the barring means is constituted solely by the abutment.

The arrangement may be such that in either form of construction the arms 29 are resiliently deformed when the sheath is in its locking state so that the abutment 30 bears against the tongue 10. The resultant friction between the abutment and the tongue assists in preventing unintended or unwanted movement of the sheath from its locking state to its release state. Alternatively, or in addition, the edge portions 24 and 25 or the sheath may frictionally engage the cap so as to assist in preventing such movement of the sheath.

FIGS. 12 to 15 show a safety-pin 38 and another design of sheath, 39. As the pin 38 is of similar form to the pins 1 and 22 the same reference numerals are applied to it. Parts of the sheath 39 are similar to corresponding parts of the sheath 23, so those are also given the same reference numerals. The principal difference between the sheaths 23 and 39 is in the form of the barring means. The curved arms 29 are omitted from the sheath 39 and are replaced by a single, tapered arm 40 which projects from one edge portion 24 of the sheath towards the other edge portion 25. An abutment 41 is formed at the narrower, free end of the arm 40. As can be best seen in FIG. 15 the abutment 41 has an inclined face 42, corresponding to the inclined face 31, and a transverse abutment face 43, corresponding to the abutment face 32.

Assembly of the sheath 39 with the pin 38 is carried out in a manner similar to the assembly of the sheath 23 with its pin 22. The sheath 39 is pushed endwise onto the cap 6 of the pin and the inclined face 42 engages the cap and causes the abutment 41 to move aside while the arm 40 flexes resiliently. Subsequently the arm is able to return the abutment substantially to its original position, though the arm 40 may remain slightly flexed in order to force the abutment into frictional engagement with the tongue 10.

In use the sheath 39 can be slid to and fro between a release state, shown in FIG. 13, and a locking state, shown in FIG. 14. When the sheath 39 is in its release state the end portion 8 of the second limb 4 of the pin is free to move between a closed state (full lines in FIG. 13) and an open state (broken lines). When the sheath is in its locking state, however, and an attempt is made to open the pin, the end portion 8 can move only a short distance inside the channel-shaped portion 9 of the cap before striking a vertical side face of the abutment 41. It can thus move no further than the position indicated by broken lines 44 in FIG. 14. The pin is therefore prevented from being moved to its open state.

As is the case with the sheath 23, edge portions of the sheath 39 may frictionally engage the cap 6 of the pin so that a significant, positive force is required to shift the sheath from one of its states to the other.

We claim:

1. A lockable safety-pin of the kind comprising a safety-pin and a locking sheath, the safety-pin comprising first and second wire limbs, a connection between adjacent ends of the first and second wire limbs, a cap at the end of the first wire limb remote from said connection, the cap having a recess opening towards the first wire limb, and a free end portion of the second wire limb remote from the connection being movable between a closed state in which it is resiliently engaged in said recess and an open state in which it is free from said recess, and the locking sheath being mounted on the cap and slidable between a locking state, in which it prevents the movement of said second wire limb from its closed state to its open state, and a release state in which it no longer prevents that movement of the second wire limb, the lockable safety-pin being characterised in that the locking sheath is made as a unitary moulding of a flexible and resilient material and includes inwardly directed abutment means, so shaped that the sheath can be assembled with the safety-pin by the sheath and cap being forced together by relative endwise movement between them, the abutment means so engaging an upstanding portion of the cap during an initial stage of that relative movement that the abutment means is moved resiliently outwards, the abutment means moving resiliently inwards again during a subsequent stage of that relative endwise movement and after said abutment means has passed said upstanding portion, said abutment including a portion so shaped that any attempt to remove the sheath from the cap, after assembly, by relative movement between the sheath and the cap in a reverse direction being positively prevented by engagement between said portion of said abutment means and the cap.

2. a lockable safety-pin according to claim 1, including an inwardly directed brake means operative to bear frictionally on the cap at least when the sheath is in its release position to prevent free movement of the sheath relative to the cap.

3. A lockable safety-pin according to claim 1 wherein said cap has inner edge means and said sheath is positively prevented from removal from said cap by engagement of said portion of said abutment means with said inner edge means when said sheath has been slid to its release state.

4. A lockable safety-pin according to claim 1 in which the abutment means comprises a pair of mutually opposed, inwardly directed abutments, each of hook-like shape, operative, when the sheath is moved to its release state, to hook onto a portion of the cap facing towards said connection so as to positively prevent removal of said sheath from said cap.

5. A lockable safety-pin according to claim 2 in which the brake means comprises at least one strip extending endwise of the sheath and so disposed that as the sheath is slid to and fro between its locking and release states successive portions thereof frictionally engage the cap.

6. A lockable safety-pin according to claim 5 in which the brake means is so shaped that as the sheath is slid towards its locking state its engagement with the cap is first reduced and then enlarged so that the sheath snaps into its locking state.

7. A lockable safety-pin according to claim 1 wherein the sheath is a unitary plastics molding.

8. A locking sheath for a safety-pin of the kind comprising first and second wire limbs, a connection between adjacent ends of the first and second wire limbs, a cap at the end of the first wire limb remote from said connection, the cap having a recess opening towards the first wire limb, and a free end portion of the second wire limb remote from the connection being movable between a closed state in which it is resiliently engaged in said recess and an open state in which it is free from said recess, the sheath comprising a unitary moulding of a flexible and resilient material, so shaped as to afford two mutually spaced, parallel side walls connected at top and lateral edges thereof by portions of channel-shaped cross-section, but unconnected at lower edges thereof, so as to leave an open mouth for entry of a cap of a safety-pin, inwardly directed abutment means on at least one of the side walls, the abutment means presenting an inclined face directed towards said open mouth and a hook formation directed away from said open mouth, and inwardly directed brake means, located on at least one of the side walls between the abutment means and the top edge thereof, the brake means projecting from the side wall less far than the hook means project to engage the cap frictionally and thus prevent free endwise movement of the sheath relative to the cap while permitting selected endwise movement of said sheath between a release state enabling movement of said pin between open and closed states and a locking state preventing movement of said pin from its closed to its open state.

9. A locking sheath according to claim 8 in which the brake means is contiguous with the adjacent abutment means.

10. A locking sheath according to claim 8 in which the brake means terminates short of the top edge of the side from which it projects.

11. A locking sheath according to claim 8 in which the outside of the sheath is formed with recessed areas which can receive the tips of a user's finger and thumb and enhance the user's grip on the sheath when the sheath is being moved from its locking state to its release state.

12. A lockable safety-pin of the kind comprising a safety-pin and a locking sheath, the safety-pin comprising first and second wire limbs, a connection between adjacent ends of the first and second wire limbs, a cap at the end of the first wire limb remote from said connection, the cap having a recess opening towards the first wire limb, and a free end portion of the second wire limb remote from the connection being movable between a closed state in which it is resiliently engaged in said recess and an open state in which it is free from said recess, and the locking sheath being mounted on the cap and slidable between a locking state, in which it prevents the movement of said second wire limb from its closed state to its open state, and a release state in which it no longer prevents that movement of the second wire limb, the lockable safety-pin being characterised in that the locking sheath is made as a unitary moulding of a flexible and resilient material and includes inwardly directed abutment means on a first side facing said connection between said limbs so shaped that the sheath can be assembled with the safety-pin by the sheath and cap being forced together by relative endwise movement between them with said one side of said abutment means so engaging an upstanding portion of the cap during an initial state of that relative movement that the abutment means is moved resiliently outwards, the abutment means moving resiliently inwards again during a subsequent stage of that relative endwise movement and after said abutment means has passed said upstanding portion, said abutment means being so shaped on its second side opposite said first side that any attempt to remove the sheath from the cap, after assembly and during normal use, by relative movement between the sheath and the cap in a reverse direction is positively prevented by engagement of the second side of the abutment means and the cap, the abutment means being disposed on at least one flexible and resilient arm cantilevered from the remainder of the sheath but constituting an integral part of the sheath.

* * * * *